US009443532B2

(12) United States Patent
Giesbrecht

(10) Patent No.: US 9,443,532 B2
(45) Date of Patent: Sep. 13, 2016

(54) NOISE REDUCTION USING DIRECTION-OF-ARRIVAL INFORMATION

(71) Applicant: David Giesbrecht, Toronto (CA)

(72) Inventor: David Giesbrecht, Toronto (CA)

(73) Assignee: QSOUND LABS, INC. (CA)

( * ) Notice: Subject to any disclaimer, the term of this patent is extended or adjusted under 35 U.S.C. 154(b) by 426 days.

(21) Appl. No.: 13/949,197

(22) Filed: Jul. 23, 2013

(65) Prior Publication Data

US 2014/0023199 A1 Jan. 23, 2014

Related U.S. Application Data

(60) Provisional application No. 61/674,798, filed on Jul. 23, 2012.

(51) Int. Cl.
*G10L 21/0216* (2013.01)
*H04R 3/00* (2006.01)

(52) U.S. Cl.
CPC ..... *G10L 21/0216* (2013.01); *H04R 3/005* (2013.01); *H04R 2499/11* (2013.01)

(58) Field of Classification Search
CPC .. H04R 3/005; H04R 3/002; H04R 2410/01; H04R 2410/05; H04R 2430/21; H04R 2430/23; G10L 21/0216; G10L 15/26; G10L 2021/02166; H04M 9/08; G01S 3/8006; G01S 3/86
USPC ..... 381/92, 93, 94.1, 94.7; 379/406.01–406.16; 704/226, 231, 704/233, 206
See application file for complete search history.

(56) References Cited

U.S. PATENT DOCUMENTS

| | | | | |
|---|---|---|---|---|
| 7,565,288 | B2 * | 7/2009 | Acero | G10L 21/0208 381/92 |
| 8,184,801 | B1 * | 5/2012 | Hamalainen | H04M 9/08 379/406.03 |
| 8,565,446 | B1 * | 10/2013 | Ebenezer | H04R 3/005 381/122 |
| 2008/0247274 | A1 * | 10/2008 | Seltzer | G01S 3/8083 367/125 |
| 2008/0288219 | A1 * | 11/2008 | Tashev | H04B 7/0854 702/190 |
| 2010/0217590 | A1 * | 8/2010 | Nemer | G01S 3/8006 704/233 |
| 2011/0307251 | A1 * | 12/2011 | Tashev | G10L 21/028 704/231 |
| 2013/0034241 | A1 * | 2/2013 | Pandey | H04R 29/007 381/92 |

OTHER PUBLICATIONS

Abad et al, "Speech enhancement and recognition by integrating adaptive beamforming and Wiener filtering", Apr. 20, 2004.*
Yoon et al, "Robust adaptive beamforming algorithm using instaneous direction of arrival with enhanced noise suppression capability", May 16, 2007.*

* cited by examiner

*Primary Examiner* — David Ton
(74) *Attorney, Agent, or Firm* — Richards Patent Law P.C.

(57) ABSTRACT

Systems and methods of improved noise reduction using direction of arrival information include: receiving audio signals from two or more acoustic sensors; applying a beamformer module to the audio signals to employ a first noise cancellation algorithm to the audio signals and combine the audio signals into an audio signal; applying a noise reduction post-filter module to the audio signal, the application of which includes: estimating a current noise spectrum of the audio signals after the application of the first noise cancellation algorithm; using spatial information derived from the audio signals received from the two or more acoustic sensors to determine a measured direction-of-arrival by estimating the current time-delay between the acoustic sensor inputs; comparing the measured direction-of-arrival to a target direction-of-arrival; applying a second noise reduction algorithm to the audio signal; and outputting a single audio stream with reduced background noise.

20 Claims, 4 Drawing Sheets

NOISE REDUCTION USING DIRECTION-OF-ARRIVAL INFORMATION

CROSS-REFERENCE TO RELATED APPLICATIONS

This application incorporates by reference and claims priority to U.S. Provisional Application No. 61/674,798, filed on Jul. 23, 2012.

BACKGROUND OF THE INVENTION

The present subject matter provides an audio system including two or more acoustic sensors, a beamformer, and a noise reduction post-filter to optimize the performance of noise reduction algorithms used to capture an audio source.

Many mobile devices and other speakerphone/handsfree communication systems, including smartphones, tablets, hand free car kits, etc., include two or more microphones or other acoustic sensors for capturing sounds for use in various applications. For example, such systems are used in speakerphones, video VOIP, voice recognition applications, audio/video recording, etc. The overall signal-to-noise ratio of the multi-microphone signals is typically improved using beamforming algorithms for noise cancellation. Generally speaking, beamformers use weighting and time-delay algorithms to combine the signals from the various microphones into a single signal. Beamformers can be fixed or adaptive algorithms. An adaptive post-filter is typically applied to the combined signal after beamforming to further improve noise suppression and audio quality of the captured signal. The post-filter is often analogous to regular mono microphone noise suppression (i.e., uses Wiener Filtering or Spectral Subtraction), but it has the advantage over the mono microphone case in that the multi microphone post-filter can also use spatial information about the sound field for enhanced noise suppression.

For far-field situations, such as speakerphone/hands-free applications in which both the target source (e.g., the user's voice) and the noise sources are located farther away from the microphones, it is common for the multi-microphone post-filter to use some variant of the so-called Zelinski post-filter. This technique derives Wiener gains using the ratio of multi-microphone cross-spectral densities to auto-spectral densities, and involves the following assumptions:

1. The target signal (e.g., the voice) and noise are uncorrelated;
2. The noise power spectrum is approximately equal at all microphones; and
3. The noise is uncorrelated between microphone signals.

Unfortunately, in real-world situations, the third assumption is not valid at low frequencies, and, if the noise source is directional, is not valid at any frequency. In addition, depending on diffraction effects due to the device's form factor, room acoustics, microphone mismatch, etc., the second assumption may not be valid at some frequencies. Therefore, the use of a Zelinski post-filter is not an ideal solution for noise reduction for multi-microphone mobile devices in real-world conditions.

Accordingly, there is a need for an efficient and effective system and method for improving the noise reduction performance of multi-microphone systems employed in mobile devices that does not rely on assumptions about inter-microphone correlation and noise power levels, as described and claimed herein.

SUMMARY OF THE INVENTION

In order to meet these needs and others, the present invention provides a system and method that employs a multi-microphone post-filter that uses direction-of-arrival information instead of relying on assumptions about inter-microphone correlation and noise power levels.

In one example, a noise reduction system includes an audio capturing system in which two or more acoustic sensors (e.g., microphones) are used. The audio device may be a mobile device and any other speakerphone/handsfree communication system, including smartphones, tablets, hand free car kits, etc. A noise reduction processor receives input from the multiple microphones and outputs a single audio stream with reduced background noise with minimal suppression or distortion of a target sound source (e.g., the user's voice).

In a primary example, the communications device (e.g. smartphone in handsfree/speakerphone mode) includes a pair of microphones used to capture audio content. An audio processor receives the captured audio signals from the microphones. The audio processor employs a beamformer (fixed or adaptive), a noise reduction post-filter, and an optional acoustic echo canceller. Information from the beamformer module can be used to determine direction-of-arrival information about the audio content and then pass this information to the noise reduction post-filter to apply an appropriate amount of noise reduction to the beamformed microphone signal as needed. For ease of description, the beamformer, the noise reduction post-filter, and the acoustic echo canceller will be referred to as "modules," though it is not meant to imply that they are necessarily separate structural elements. As will be recognized by those skilled in the art, the various modules may or may not be embodied in a single audio processor.

In the primary example, the beamformer module employs noise cancellation techniques by combining the multiple microphone inputs in either a fixed or adaptive manner (e.g., delay-sum beamformer, filter-sum beamformer, generalized side-lobe canceller). If needed, the acoustic echo canceller module can be used to remove any echo due to speaker-to-microphone feedback paths. The noise reduction post-filter module is then used to augment the beamformer and provide additional noise suppression. The function of the noise reduction post-filter module is described in further detail below.

The main steps of the noise reduction post-filter module can be labeled as: (1) mono noise estimate; (2) direction-of-arrival analysis; (3) calculation of the direction-of-arrival enhanced noise estimate; and (4) noise reduction using enhanced noise estimate. Summaries of each of these functions follow.

The mono noise estimate involves estimating the current noise spectrum of the mono input provided to the noise reduction post-filter module (i.e., the mono output after the beamformer module). Common techniques used for mono channel noise estimation, such as frequency-domain minimum statistics or other similar algorithms, that can accurately track stationary, or slowly-changing background noise, can be employed in this step.

The direction-of-arrival analysis uses spatial information from the multi-microphone inputs to improve the noise estimate to better track non-stationary noises. The direction-of-arrival of the incoming audio signals is analyzed by estimating the current time-delay between the microphone inputs (e.g., via cross-correlation techniques) and/or by analyzing the frequency domain phase differences between microphones. The frequency domain approach is advantageous because it allows the direction-of-arrival to be estimated separately in different frequency subbands. The direction-of-arrival result is then compared to a target direction (e.g., the expected direction of the target user's voice). The difference between the direction-of-arrival result and the target direction is then used to adjust the noise estimate as described below.

The relationship between the direction-of-arrival result and the target direction is used to enhance the spectral noise estimate using the logic described below. This logic may be performed on the overall signal levels or on a subband-by-subband basis.

If the direction-of-arrival result is very close to the target direction, there is a high probability the incoming signal is dominated by target voice. Thus, no enhancement of the noise estimate is needed.

Alternatively, if the direction-of-arrival result is very different from the target direction, there is a high probability the incoming signal is dominated by noise. Therefore, the noise estimate is boosted so that the current signal-to-noise ratio estimate approaches 0 dB or some other minimum value.

Alternatively, if the direction-of-arrival result is somewhere in between these extremes, it is assumed the signal is dominated by some mixture of both target voice and noise. Therefore, the noise estimate is boosted by some intermediate amount according to a boosting function (of direction-of-arrival [deg] vs. the amount of boost [dB]). There are many different possibilities for feasible boosting functions, but in many applications a linear or quadratic function performs adequately.

It should be noted that the shape of the boosting function can be tuned to adjust the amount of spatial enhancement of the spectral noise estimate, e.g., the algorithm can be easily tuned to have a narrow target direction-of-arrival region and more aggressively reject sound sources coming from other directions, or conversely, the algorithm can be have a wider direction-of-arrival region and be more conservative in rejecting sounds from other directions. This latter option can be advantageous for applications where a) multiple target sources might be present and/or b) the target user's location might move around somewhat. In such cases, an aggressive sound rejection algorithm may suppress too much of the target sound source.

The final function, noise reduction using enhanced noise estimate, uses the enhanced spectral noise estimate to perform noise reduction on the input audio signal. Common noise reduction techniques such as Wiener filtering or spectral subtraction can be used here. However, because the noise estimate has been enhanced to include spatial direction-of-arrival information, the system is more robust in non-stationary noise environments. As a result, the amount of achievable noise reduction is superior to traditional mono noise reduction algorithms, as well as previous multi-microphone post filters.

While the primary example has been described above, it is understood that there may be various enhancements made to the systems and methods described herein. For example, in a given application, the target direction-of-arrival direction may be a pre-tuned parameter or it may be altered in real-time using a detected state or orientation of the mobile device. Description of examples of altering the target direction-of-arrival direction is provided in U.S. Patent Publication No. 2013/0121498 A1, the entirety of which is incorporated by reference.

It may be desirable in some applications for the algorithm to monitor and/or actively switch between multiple target directions-of-arrivals simultaneously, e.g., when multiple users are seated around a single speakerphone on a desk, or for automotive applications where multiple passengers are talking into a hands-free speakerphone at the same time.

In some applications involving mobile devices such as smartphones or tablets, the device and user may move with respect to each other. In these situations, optimal noise reduction performance can be achieved by including a sub-module to adaptively track the target voice direction-of-arrival in real-time. For example, a voice activity detector algorithm may be used. Common voice activity detector algorithms include signal-to-noise based and/or pitch detection techniques to determine when voice activity is present. In this manner, the voice activity detector can be used to determine when the target voice direction-of-arrival should be adapted to ensure robust tracking of a moving target. In addition, adapting the target direction-of-arrival separately on a subband-by-subband basis allows the system to inherently compensate for inter-microphone phase differences due to microphone mismatch, device form factor, and room acoustics (i.e., the target direction-of-arrival is not constrained to be the same in all frequency bands).

For implementations involving both adaptive target direction-of-arrival tracking (described above) as well as an acoustic echo canceller, it is often advantageous to disable the target direction-of-arrival tracking when the speaker channel is active (i.e., when the far-end person is talking). This prevents the target direction-of-arrival from steering towards the device's speaker(s).

In one example, an audio device includes: an audio processor and memory coupled to the audio processor, wherein the memory stores program instructions executable by the audio processor, wherein, in response to executing the program instructions, the audio processor is configured to: receive two or more audio signals from two or more acoustic sensors; apply a beamformer module to the audio signals and to employ a first noise cancellation algorithm to the audio signals and combine the audio signals into an audio signal; apply a noise reduction post-filter module to the audio signal, the application of which includes: estimating a current noise spectrum of the audio signal after the application of the first noise cancellation algorithm; using spatial information derived from the audio signals received from the two or more acoustic sensors to determine a measured direction-of-arrival; comparing the measured direction-of-arrival to a target direction-of-arrival; applying a second noise reduction algorithm in proportion to the difference between the measured direction-of-arrival and the target direction-of-arrival; and output a single audio stream with reduced background noise. In some embodiments, the audio processor is further configured to apply an acoustic echo canceller module to the audio signal to remove echo due to speaker-to-microphone feedback paths.

The first noise cancellation algorithm may be a fixed noise cancellation algorithm or an adaptive noise cancellation algorithm.

The audio processor may be further configured to track stationary or slowly-changing background noise by estimating, using frequency-domain minimum statistics, the noise spectrum of the received audio signal after the application of the first noise cancellation algorithm.

The audio processor may be further configured to determine a measured direction-of-arrival by estimating the current time-delay between the acoustic sensor inputs. The measured direction-of-arrival may be estimated using cross-correlation techniques, by analyzing the frequency domain phase differences between the two acoustic sensor, and by other methods that will be understood by those skilled in the art based on the disclosures provided herein. Further, the direction-of-arrival may be estimated separately in different frequency subbands.

The second noise reduction algorithm may be a Wiener filter, a spectral subtraction filter, or other methods that will be understood by those skilled in the art based on the disclosures provided herein. The target direction-of-arrival may be altered in real-time to adjust to changing conditions. In some embodiments, a user may select the target direction-of-arrival, the direction-of-arrival may be set by an orientation sensor, or other methods of adjusting the direction-of-arrival may be implemented. In some embodiments, the audio processor is configured to actively switch between multiple target directions-of-arrival. The audio processor may be further configured to disable the active switching between multiple target directions-of-arrival when a speaker channel is active. The active switching of the target directions-of-arrival may be based on the use of a voice activity detector that determines when voice activity is present.

In another example, a computer implemented method of reducing noise in an audio signal captured in an audio device includes the steps of: receiving two or more audio signals from two or more acoustic sensors; applying a beamformer module to the audio signals and to employ a first noise cancellation algorithm to the audio signals and combine the audio signals into an audio signal; applying a noise reduction post-filter module to the audio signal, the application of which includes: estimating a current noise spectrum of the audio signal after the application of the first noise cancellation algorithm; using spatial information derived from the audio signals received from the two or more acoustic sensors to determine a measured direction-of-arrival by estimating the current time-delay between the acoustic sensor inputs; comparing the measured direction-of-arrival to a target direction-of-arrival; applying a second noise reduction algorithm to the audio signal in proportion to the difference between the measured direction-of-arrival and the target direction-of-arrival; and outputting a single audio stream with reduced background noise. The method may optionally include the step of applying an acoustic echo canceller module to the audio signal to remove echo due to speaker-to-microphone feedback paths.

In yet another example, a computer implemented method of reducing noise in an audio signal captured in an audio device includes the steps of: receiving two or more audio signals from two or more acoustic sensors; applying a beamformer module to the audio signals and to employ a first noise cancellation algorithm to the audio signals and combine the audio signals into an audio signal; applying an acoustic echo canceller module to the audio signal to remove echo due to speaker-to-microphone feedback paths; applying a noise reduction post-filter module to the audio signal, the application of which includes: estimating, using frequency-domain minimum statistics, a current noise spectrum of the audio signal after the application of the first noise cancellation algorithm; using spatial information derived from the audio signals received from the two or more acoustic sensors to determine a measured direction-of-arrival by estimating the current time-delay between the acoustic sensor inputs, wherein the direction-of-arrival is measured separately in different frequency subbands; comparing the measured direction-of-arrival to a target direction-of-arrival, applying a second noise reduction algorithm to the audio signal in proportion to the difference between the measured direction-of-arrival and the target direction-of-arrival while actively switching between multiple target directions-of-arrival in real time and disabling the active switching between multiple target directions-of-arrival when a speaker channel is active; and outputting a single audio stream with reduced background noise. The method may be implemented by an audio processor and memory coupled to the audio processor, wherein the memory stores program instructions executable by the audio processor, wherein, in response to executing the program instructions, the audio processor performs the method.

The systems and methods taught herein provide efficient and effective solutions for improving the noise reduction performance of audio devices using multiple microphones for audio capture.

Additional objects, advantages and novel features of the present subject matter will be set forth in the following description and will be apparent to those having ordinary skill in the art in light of the disclosure provided herein. The objects and advantages of the invention may be realized through the disclosed embodiments, including those particularly identified in the appended claims.

BRIEF DESCRIPTION OF THE DRAWINGS

The drawings depict one or more implementations of the present subject matter by way of example, not by way of limitation. In the figures, the reference numbers refer to the same or similar elements across the various drawings.

DETAILED DESCRIPTION OF THE INVENTION

Figure 1:
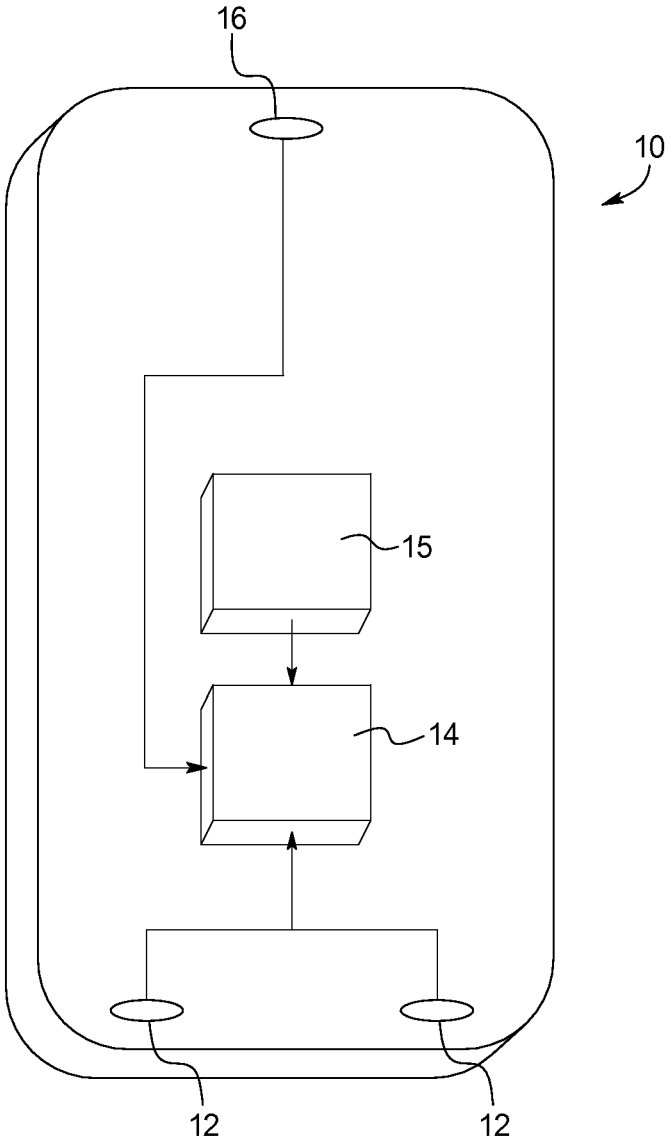
FIG. 1 is a schematic representation of a handheld device that applies noise suppression algorithms to audio content captured from a pair of microphones.

FIG. 1 illustrates a preferred embodiment of an audio device 10 according to the present invention. As shown in FIG. 1, the device 10 includes two acoustic sensors 12, an audio processor 14, memory 15 coupled to the audio processor 14, and a speaker 16. In the example shown in FIG. 1, the device 10 is a smartphone and the acoustic sensors 12 are microphones. However, it is understood that the present invention is applicable to numerous types of audio devices 10, including smartphones, tablets, hand free car kits, etc., and that other types of acoustic sensors 12 may be implemented. It is further contemplated that various embodiments of the device 10 may incorporate a greater number of acoustic sensors 12.

The audio content captured by the acoustic sensors 12 is provided to the audio processor 14. The audio processor 14 applies noise suppression algorithms to audio content, as described further herein. The audio processor 14 may be any type of audio processor, including the sound card and/or audio processing units in typical handheld devices 10. An example of an appropriate audio processor 14 is a general purpose CPU such as those typically found in handheld devices, smartphones, etc. Alternatively, the audio processor 14 may be a dedicated audio processing device. In a preferred embodiment, the program instructions executed by the audio processor 14 are stored in memory 15 associated with the audio processor 14. While it is understood that the memory 15 is typically housed within the device 10, there may be instances in which the program instructions are provided by memory 15 that is physically remote from the audio processor 14. Similarly, it is contemplated that there may be instances in which the audio processor 14 may be provided remotely from the audio device 10.

Figure 2:
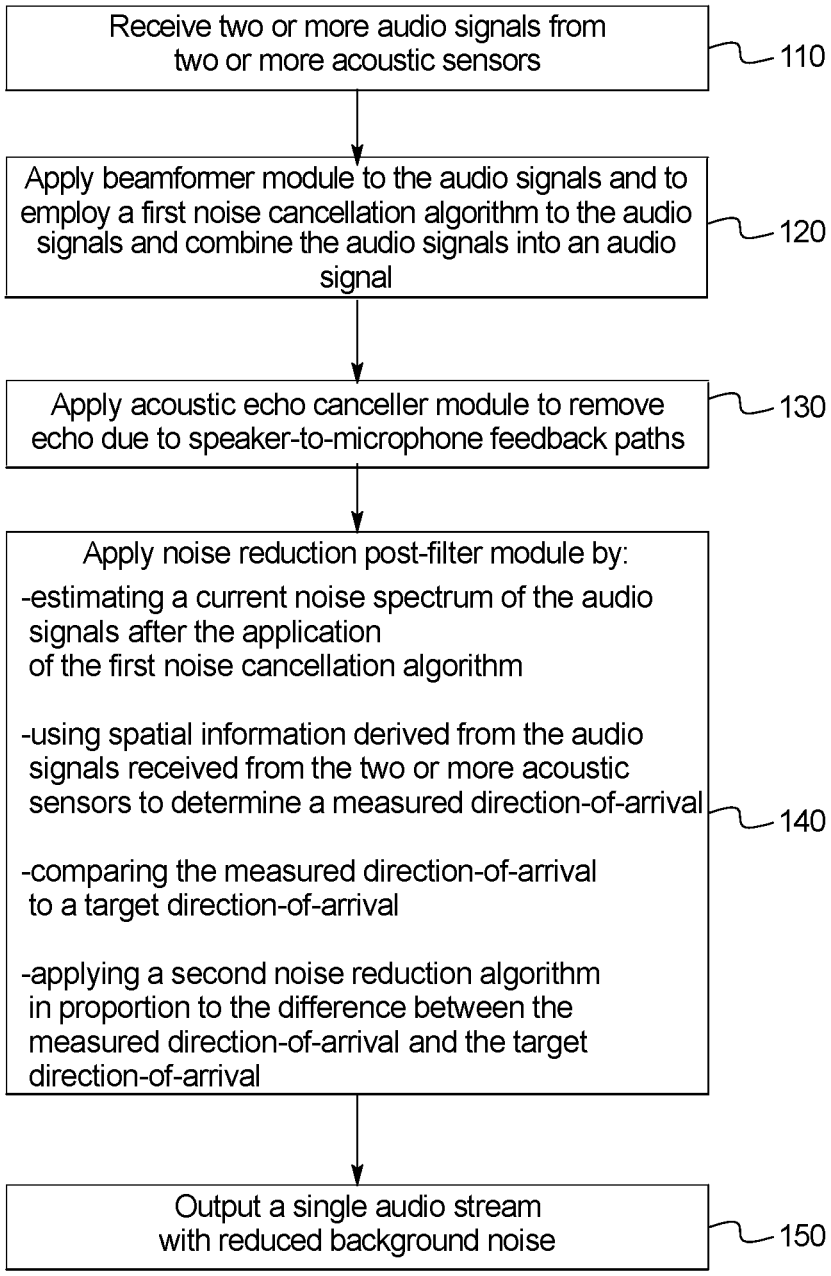
FIG. 2 is a flow chart illustrating a method of applying noise suppression algorithms to audio content captured from a pair of microphones.

Turning now to FIG. 2, a process flow for providing improved noise reduction using direction-of-arrival information 100 is provided (referred to herein as process 100). The process 100 may be implemented, for example, using the audio device 10 shown in FIG. 1. However, it is understood that the process 100 may be implemented on any number of types of audio devices 10. Further illustrating the process, FIG. 3 is a schematic block diagram of an example of a noise suppression algorithm.

Figure 3:
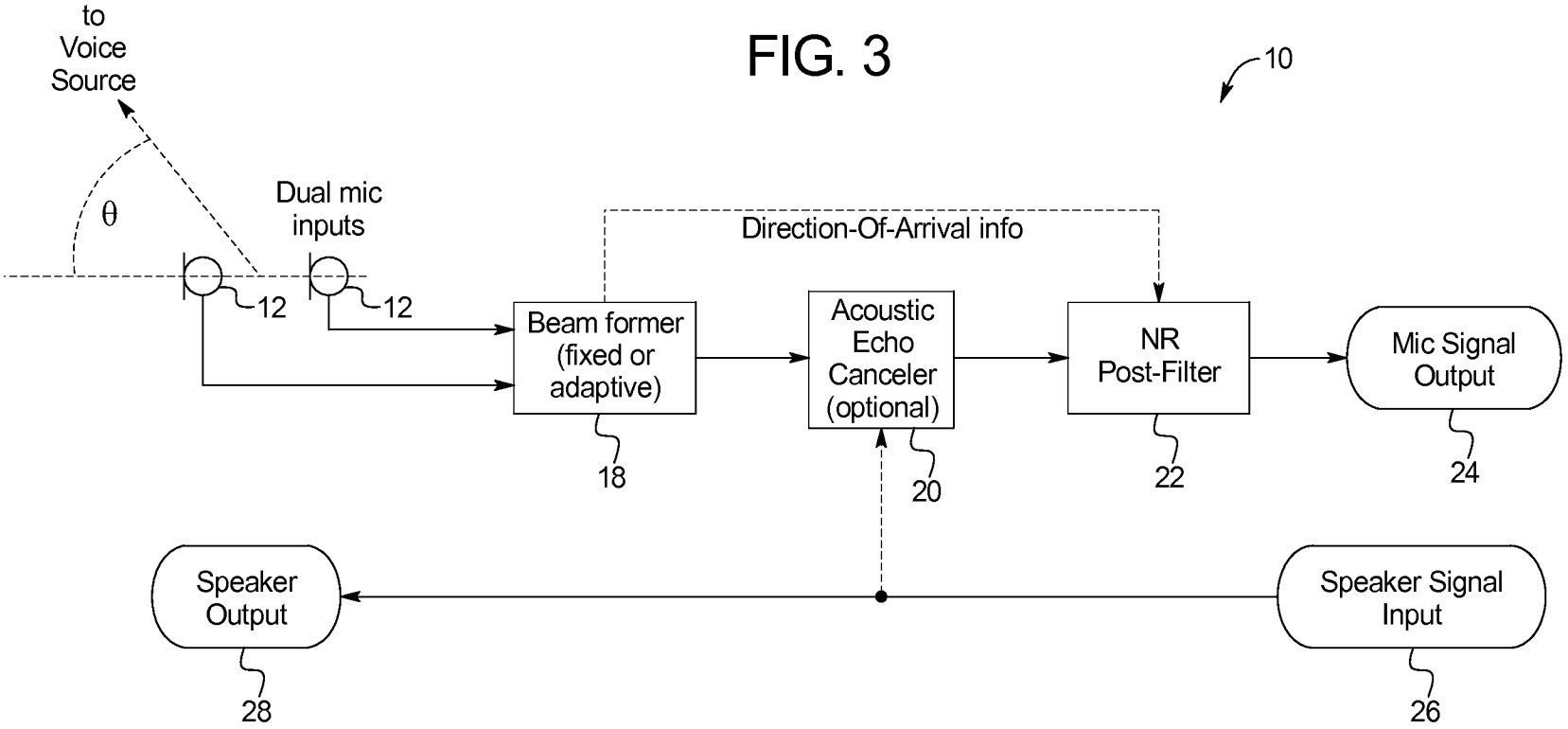
FIG. 3 is a block diagram of an example of a noise suppression algorithm.

As shown in FIGS. 2 and 3, the process 100 includes a first step 110 of receiving two or more audio signals from the two or more acoustic sensors 12. These are the audio signals that are acted on by the audio processor 14 to reduce the noise present in the signals, as described herein. For example, when the audio device 10 is a smartphone, the goal may be to capture two or more audio signals including a strong signal of the user's voice, while suppressing background noises. However, those skilled in the art will appreciate numerous variations in use and context in which the process 100 may be implemented to improve audio signals.

As shown in FIGS. 2 and 3, a second step 120, includes applying a beamformer module 18 to the audio signals and to employ a first noise cancelling algorithm to the audio signals and combine the audio signals into an audio signal. A fixed or an adaptive beamformer 18 may be implemented. For example, the fixed beamformer 18 may be a delay-sum, filter-sum, or other fixed beamformer 18. The adaptive beamformer 18 may be, for example, a generalized sidelobe canceller or other adaptive beamformer 18.

In FIGS. 2 and 3, an optional third step 130 is shown wherein an acoustic echo canceller module 20 is applied to remove echo due to speaker-to-microphone feedback paths. The use of an acoustic echo canceller 20 may be advantageous in instances in which the audio device 10 is used for telephony communication, for example in speakerphone, VOIP or video-phone application. In these cases, a multi-microphone beamformer 18 is combined with an acoustic echo canceller 20 to remove speaker-to-microphone feedback. The acoustic echo canceller 20 is typically implemented after the beamformer 18 to save on processor and memory allocation (if placed before the beamformer 18, a separate acoustic echo canceller 20 is typically implemented for each microphone channel rather than on the mono signal output from the beamformer 18). As shown in FIG. 3, the acoustic echo canceller 20 receives as input the speaker signal input 26 and the speaker output 28.

As shown in FIGS. 2 and 3, a fourth step 140 of applying a noise reduction post-filter module 22 is shown. The noise reduction post-filter module 22 is used to augment the beamformer 18 and provide additional noise suppression. The function of the noise reduction post-filter module 22 is described in further detail below.

The main steps of the noise reduction post-filter module 22 can be labeled as: (1) mono noise estimate; (2) direction-of-arrival analysis; (3) calculation of the direction-of-arrival enhanced noise estimate; and (4) noise reduction using enhanced noise estimate. Descriptions of each of these functions follow.

The mono noise estimate involves estimating the current noise spectrum of the mono input provided to the noise reduction post-filter module 22 (i.e., the mono output after the beamformer module 18). Common techniques used for mono channel noise estimation, such as frequency-domain minimum statistics or other similar algorithms, that can accurately track stationary, or slowly-changing background noise, can be employed in this step.

The direction-of-arrival analysis uses spatial information from the multiple microphones 12 to improve the noise estimate to better track non-stationary noises. The direction-of-arrival of the incoming audio signals is analyzed by estimating the current time-delay between the microphones 12 (e.g., via cross-correlation techniques) and/or by analyzing the frequency domain phase differences between microphones 12. The frequency domain approach is advantageous because it allows the direction-of-arrival to be estimated separately in different frequency subbands. The direction-of-arrival result is then compared to a target direction (i.e., the expected direction of the target user's voice). The difference between the direction-of-arrival result and the target direction is then used to adjust the noise estimate as described below.

The relationship between the direction-of-arrival result and the target direction is used to enhance the spectral noise estimate using the logic described below. An example is provided in FIG. 4. While shown in FIG. 4 as a single relationship between the noise estimate boost and the difference between the measured direction-of-arrival and the target direction-of-arrival, it is understood that this logic may be performed on the overall signal levels or on a subband-by-subband basis.

If the measured direction-of-arrival is close to the target direction-of-arrival, there is a high probability the incoming signal is dominated by target voice. Thus, no enhancement of the noise estimate is needed. In the example provided in FIG. 4, no enhancement to the noise estimate is provided when the measured direction-of-arrival is within about seventeen degrees of the target direction-of-arrival.

If the direction-of-arrival result is very different from the target direction, there is a high probability the incoming signal is dominated by noise. Therefore, the noise estimate is boosted so that the current signal to noise ratio estimate approaches 0 dB or some other minimum value.

Figure 4:
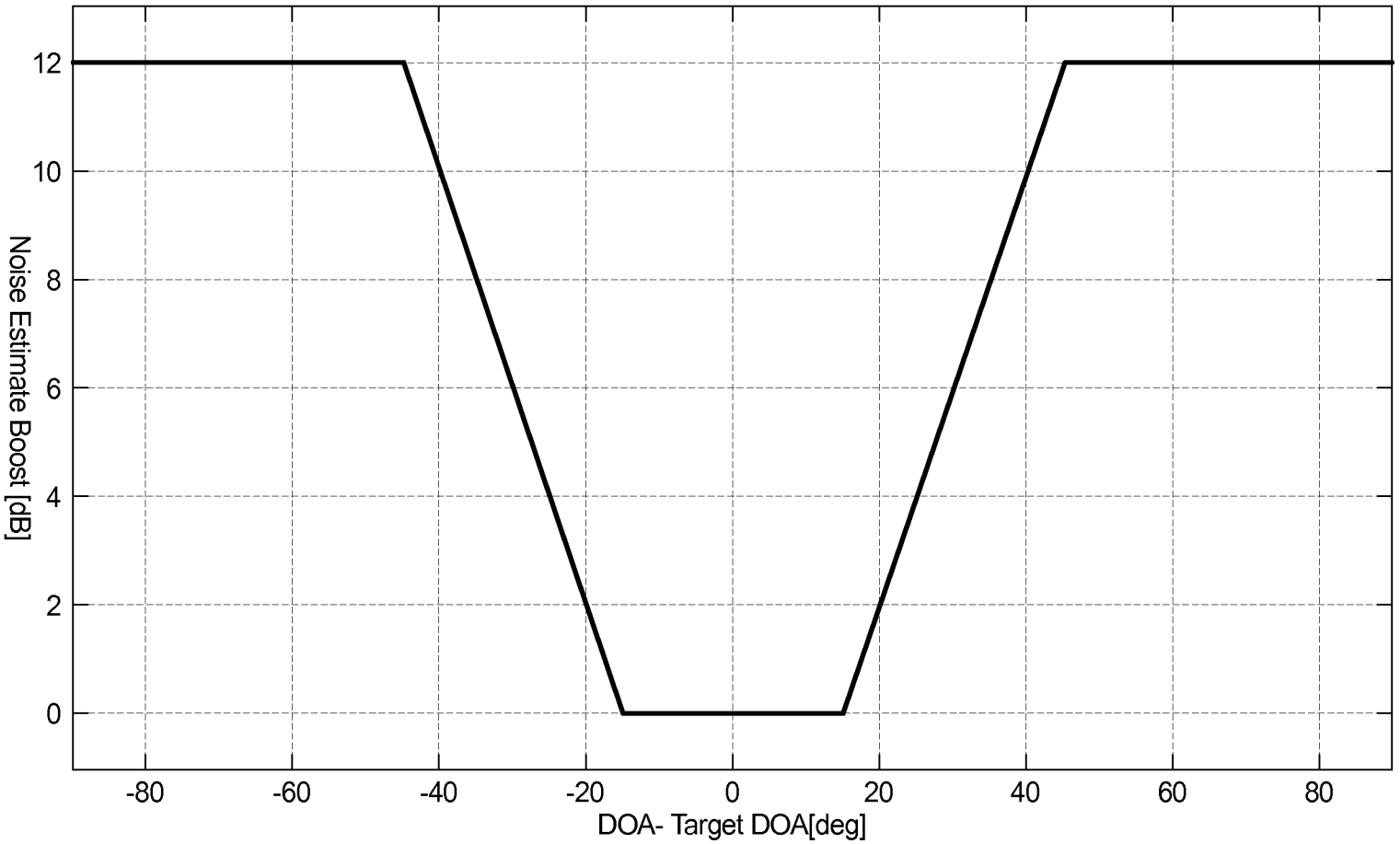
FIG. 4 is an example of a noise suppression algorithm that applies varying noise suppression based on the difference between a measured direction-of-arrival and a target direction-of-arrival.

Alternatively, if the direction-of-arrival result is somewhere in between these extremes, it is assumed the signal is dominated by some mixture of both target voice and noise. Therefore, the noise estimate is boosted by some intermediate amount according to a boosting function (e.g., a function of direction-of-arrival [deg] vs. the amount of boost [dB]). There are many different possibilities for feasible boosting functions, but in many applications a linear (as shown in FIG. 4) or quadratic function performs adequately. FIG. 4 shows an example noise estimate boosting function using a piecewise linear function. In this example, the noise estimate may be boosted by up to 12 dB if the current direction of arrival of the microphone signals is more than 45 degrees away from the target voice's direction-of-arrival.

It should be noted that the shape of the boosting function can be tuned to adjust the amount of spatial enhancement of the spectral noise estimate, e.g., the algorithm can be easily tuned to have a narrow target direction-of-arrival region and more aggressively reject sound sources coming from other directions, or conversely, the algorithm can be have a wider direction-of-arrival region and be more conservative in rejecting sounds from other directions. This latter option can be advantageous for applications where a) multiple target sources might be present and/or b) the target user's location might move around somewhat. In such cases, an aggressive sound rejection algorithm may reject a greater degree of the target sound source than desired.

The final function, noise reduction using enhanced noise estimate, uses the enhanced spectral noise estimate to perform noise reduction on the audio signal. Common noise reduction techniques such as Wiener filtering or spectral subtraction can be used here. However, because the noise estimate has been enhanced to include spatial direction-of-arrival information, the system is more robust in non-stationary noise environments. As a result, the amount of achievable noise reduction is superior to traditional mono noise reduction algorithms, as well as previous multi-microphone post filters.

While the primary example has been described above, it is understood that there may be various enhancements made to the systems and methods described herein. For example, in a given application, the target direction-of-arrival direction may be a pre-tuned parameter or it may be altered in real-time using a detected state or orientation of the audio device 10. Description of examples of altering the target direction-of-arrival direction is provided in U.S. Patent Publication No. 2013/0121498 A1, the entirety of which is incorporated by reference.

It may be desirable in some applications for the algorithm to monitor and/or actively switch between multiple target directions-of-arrivals simultaneously, e.g., when multiple users are seated around a single speakerphone on a desk, or for automotive applications where multiple passengers are talking into a hands-free speakerphone at the same time.

In some applications involving audio devices 10 such as smartphones or tablets, the audio device 10 and user may move with respect to each other. In these situations, optimal noise reduction performance can be achieved by including a sub-module to adaptively track the target voice direction-of-arrival in real-time. For example, a voice activity detector algorithm may be used. Common voice activity detector algorithms include signal-to-noise based and/or pitch detection techniques to determine when voice activity is present. In this manner, the voice activity detector can be used to determine when the target voice direction-of-arrival should be adapted to ensure robust tracking of a moving target. In addition, adapting the target direction-of-arrival separately on a subband-by-subband basis allows the system to inherently compensate for inter-microphone phase differences due to microphone 12 mismatch, audio device 10 form factor, and room acoustics (i.e., the target direction-of-arrival is not constrained to be the same in all frequency bands).

For implementations involving both adaptive target direction-of-arrival tracking (described above) as well as an acoustic echo canceller 20, it is often advantageous to disable the target direction-of-arrival tracking when the speaker channel is active (i.e., when the far-end person is talking). This prevents the target direction-of-arrival from steering towards the audio device's speaker(s) 16.

Turning back to FIG. 2, a fifth step 150 completes the process 100 by outputting a single audio stream with reduced background noise compared to the input audio signal received by the acoustic sensors 12.

It should be noted that various changes and modifications to the presently preferred embodiments described herein will be apparent to those skilled in the art. Such changes and modification may be made without departing from the spirit and scope of the present invention and without diminishing its advantages.

I claim:

1. An audio device comprising:

an audio processor and memory coupled to the audio processor, wherein the memory stores program instructions executable by the audio processor, wherein, in response to executing the program instructions, the audio processor is configured to:

receive two or more audio signals from two or more acoustic sensors;

apply a beamformer module to the audio signals to employ a first noise cancellation algorithm to the audio signals and combine the audio signals into an audio signal;

apply a noise reduction post-filter module to the audio signal, wherein the step of applying the noise reduction post-filter module includes:

estimating a current noise spectrum of the audio signal after the application of the first noise cancellation algorithm;

using spatial information derived from the audio signals received from the two or more acoustic sensors to determine a measured direction-of-arrival;

comparing the measured direction-of-arrival to a target direction-of-arrival;

applying a second noise reduction algorithm in proportion to the difference between the measured direction-of-arrival and the target direction-of-arrival; and output a single audio stream with reduced background noise.

2. The device of claim 1 wherein, in response to executing the program instructions, the audio processor is further configured to apply an acoustic echo canceller module to the audio signal to remove echo due to speaker-to-microphone feedback paths.

3. The device of claim 1 wherein the beamformer module employs a first noise cancellation algorithm that is a fixed noise cancellation algorithm.

4. The device of claim 1 wherein the beamformer module employs a first noise cancellation algorithm that is an adaptive noise cancellation algorithm.

5. The device of claim 1 wherein, in response to executing the program instructions, the audio processor is further configured to track stationary or slowly-changing background noise by estimating, using frequency-domain minimum statistics, the noise spectrum of the audio signals after the application of the first noise cancellation algorithm.

6. The device of claim 1 wherein, in response to executing the program instructions, the audio processor is further configured to determine a measured direction-of-arrival by estimating the current time-delay between the acoustic sensor inputs.

7. The device of claim 6 wherein the measured direction-of-arrival is estimated using cross-correlation techniques.

8. The device of claim 6 wherein the measured direction-of-arrival is estimated by analyzing the frequency domain phase differences between the two acoustic sensors.

9. The device of claim 6 wherein the direction-of-arrival is estimated separately in different frequency subbands.

10. The device of claim 1 wherein the second noise reduction algorithm is a Wiener filter.

11. The device of claim 1 wherein the second noise reduction algorithm is a spectral subtraction filter.

12. The device of claim 1 wherein the target direction-of-arrival is altered in real-time.

13. The device of claim 1 wherein, in response to executing the program instructions, the audio processor is further configured to actively switch between multiple target directions-of-arrival.

14. The device of claim 13 wherein, in response to executing the program instructions, the audio processor is further configured to disable actively switching between multiple target directions-of-arrival when a speaker channel is active.

15. The device of claim 1 wherein, in response to executing the program instructions, the audio processor is further configured to use a voice activity detector to determine when voice activity is present.

16. The device of claim 1 wherein the target direction-of-arrival includes distinct values for at least two subbands.

17. A computer implemented method of reducing noise in an audio signal captured in an audio device comprising the steps of:

receiving two or more audio signals from two or more acoustic sensors;

applying a beamformer module to the two or more audio signals to employ a first noise cancellation algorithm to the audio signals and combine the audio signals into an audio signal;

applying a noise reduction post-filter module to the audio signal, wherein the step of applying the noise reduction post-filter module includes:

estimating a current noise spectrum of the audio signal after the application of the first noise cancellation algorithm;

using spatial information derived from the audio signals received from the two or more acoustic sensors to determine a measured direction-of-arrival by estimating the current time-delay between the acoustic sensor inputs;

comparing the measured direction-of-arrival to a target direction-of-arrival;

applying a second noise reduction algorithm to the audio signal in proportion to the difference between the measured direction-of-arrival and the target direction-of-arrival; and outputting a single audio stream with reduced background noise.

18. The method of claim 17 further comprising the step of applying an acoustic echo canceller module to the audio signal to remove echo due to speaker-to-microphone feedback paths.

19. A computer implemented method of reducing noise in an audio signal captured in an audio device comprising the steps of:

receiving two or more audio signal from two or more acoustic sensors;

applying a beamformer module to the two or more audio signals to employ a first noise cancellation algorithm to the audio signals and combine the audio signals into an audio signal;

applying an acoustic echo canceller module to the audio signal to remove echo due to speaker-to-microphone feedback paths;

applying a noise reduction post-filter module to the audio signal, wherein the step of applying the noise reduction post-filter module includes:

estimating, using frequency-domain minimum statistics, a current noise spectrum of the audio signals after the application of the first noise cancellation algorithm;

using spatial information derived from the audio signals received from the two or more acoustic sensors to determine a measured direction-of-arrival by estimating the current time-delay between the acoustic sensor inputs, wherein the direction-of-arrival is measured separately in different frequency subbands;

comparing the measured direction-of-arrival to a target direction-of-arrival, wherein the target direction-of-arrival includes distinct values for at least two subbands;

applying a second noise reduction algorithm to the audio signal in proportion to the difference between the measured direction-of-arrival and the target direction-of-arrival while actively switching between multiple target directions-of-arrival in real time and disabling the active switching between multiple target directions-of-arrival when a speaker channel is active; and outputting a single audio stream with reduced background noise.

20. The method of claim 19 wherein the steps are executed by an audio processor coupled to memory, wherein the memory stores program instructions executable by the audio processor, wherein, in response to executing the program instructions, the audio processor performs the method.

* * * * *